US011454006B2

(12) United States Patent
Ishibashi et al.

(10) Patent No.: US 11,454,006 B2
(45) Date of Patent: Sep. 27, 2022

(54) CONTROL SYSTEM FOR WORK VEHICLE, METHOD AND WORK VEHICLE

(71) Applicant: KOMATSU LTD., Tokyo (JP)

(72) Inventors: Eiji Ishibashi, Tokyo (JP); Takahiro Shimojo, Tokyo (JP)

(73) Assignee: KOMATSU LTD., Tokyo (JP)

( * ) Notice: Subject to any disclaimer, the term of this patent is extended or adjusted under 35 U.S.C. 154(b) by 405 days.

(21) Appl. No.: 16/482,079

(22) PCT Filed: May 9, 2018

(86) PCT No.: PCT/JP2018/017984
§ 371 (c)(1),
(2) Date: Jul. 30, 2019

(87) PCT Pub. No.: WO2018/216470
PCT Pub. Date: Nov. 29, 2018

(65) Prior Publication Data

US 2020/0056353 A1 Feb. 20, 2020

(30) Foreign Application Priority Data

May 23, 2017 (JP) ..... JP2017-101364

(51) Int. Cl.
*E02F 9/26* (2006.01)
*E02F 9/20* (2006.01)
(Continued)

(52) U.S. Cl.
CPC ..... *E02F 9/262* (2013.01); *E02F 3/7609* (2013.01); *E02F 3/844* (2013.01); *E02F 9/2041* (2013.01); *E02F 9/265* (2013.01)

(58) Field of Classification Search
CPC ..... E02F 9/262; E02F 3/844; E02F 3/7618; E02F 3/847; E02F 9/265; E02F 3/84;
(Continued)

(56) References Cited

U.S. PATENT DOCUMENTS 3,563,016 A * 2/1971 Tolochko ..... A01D 46/28 56/331
5,375,663 A * 12/1994 Teach ..... E02F 3/847 701/50
(Continued)

FOREIGN PATENT DOCUMENTS

CN 106494404 A 3/2017
JP 1-193651 A 8/1989
(Continued)

OTHER PUBLICATIONS

The International Search Report for the corresponding international application No. PCT/JP2018/017984, dated Jun. 26, 2018.
(Continued)

*Primary Examiner* — Edwin J Toledo-Duran
(74) *Attorney, Agent, or Firm* — Global IP Counselors, LLP

(57) ABSTRACT

A work vehicle includes a travel device and a work implement. A control system for the work vehicle includes a controller. The controller controls the work implement according to a predetermined target value. The controller determines whether a slip of the travel device has occurred during control of the work implement. The controller changes the target value according to a result of determination of the slip.

17 Claims, 10 Drawing Sheets

(51) Int. Cl.
*E02F 3/76* (2006.01)
*E02F 3/84* (2006.01)

(58) Field of Classification Search
CPC . E02F 9/20; E02F 3/7609; E02F 3/841; E02F 3/76; E02F 9/205; E02F 3/845; G05D 1/0212; G05D 2201/0202; G05D 1/0094; G05D 1/0274; G05D 1/0278
See application file for complete search history.

(56) References Cited

U.S. PATENT DOCUMENTS

| | | | | |
|---|---|---|---|---|
| 5,555,942 | A * | 9/1996 | Matsushita | E02F 3/844 172/3 |
| 5,621,643 | A * | 4/1997 | Nakagami | E02F 9/2029 172/3 |
| 5,875,854 | A | 3/1999 | Yamamoto et al. | |
| 6,181,999 | B1 | 1/2001 | Yamamoto et al. | |
| 10,275,843 | B2 * | 4/2019 | Shike | G06Q 10/06313 |
| 11,053,667 | B2 * | 7/2021 | Harada | E02F 3/844 |
| 2011/0153170 | A1 | 6/2011 | Dishman et al. | |
| 2013/0081831 | A1 | 4/2013 | Hayashi | |
| 2014/0180444 | A1 * | 6/2014 | Edara | G05D 1/00 700/56 |
| 2014/0180547 | A1 * | 6/2014 | Edara | G05D 1/0278 701/50 |
| 2014/0277957 | A1 * | 9/2014 | Clar | E02F 5/32 701/50 |
| 2015/0019086 | A1 | 1/2015 | Hayashi et al. | |
| 2015/0308081 | A1 * | 10/2015 | Takaura | E02F 3/437 701/50 |
| 2016/0076222 | A1 * | 3/2016 | Taylor | E02F 9/2045 701/50 |
| 2016/0076223 | A1 * | 3/2016 | Wei | E02F 3/435 701/50 |
| 2016/0321763 | A1 * | 11/2016 | Shike | G06Q 50/08 |
| 2017/0066325 | A1 | 3/2017 | Brownell et al. | |
| 2019/0194912 | A1 * | 6/2019 | Ishibashi | G05D 1/0274 |
| 2019/0234045 | A1 * | 8/2019 | Wiewel | E02F 3/845 |
| 2020/0011034 | A1 * | 1/2020 | Atkinson | E02F 3/842 |

FOREIGN PATENT DOCUMENTS

| | | | |
|---|---|---|---|
| JP | 8-19693 | B2 | 2/1996 |
| JP | 10-88612 | A | 4/1998 |
| JP | 3537182 | B2 | 6/2004 |
| JP | 3763638 | B2 | 4/2006 |
| JP | 2013-515885 | A | 5/2013 |
| JP | 5247939 | B1 | 7/2013 |
| JP | 2014-84683 | A | 5/2014 |
| WO | 2008/118027 | A2 | 10/2008 |

OTHER PUBLICATIONS

The Office Action for the corresponding Japanese application No. 2017-101364, dated Jul. 28, 2020.
The Office Action for the corresponding Japanese application No. 2017-101364, dated Feb. 16, 2021.
The Office Action for the corresponding Chinese application No. 20180007122.X, dated Oct. 19, 2020.

* cited by examiner

CONTROL SYSTEM FOR WORK VEHICLE, METHOD AND WORK VEHICLE

CROSS-REFERENCE TO RELATED APPLICATIONS

This application is a U.S. National stage application of International Application No. PCT/JP2018/017984, filed on May 9, 2018. This U.S. National stage application claims priority under 35 U.S.C. § 119(a) to Japanese Patent Application No. 2017-101364, filed in Japan on May 23, 2017, the entire contents of which are hereby incorporated herein by reference.

BACKGROUND

Field of the Invention

The present invention relates to a control system for a work vehicle, a method, and a work vehicle.

Background Information

Conventionally, automatic control for automatically adjusting the position of a work implement has been proposed for work vehicles such as bulldozers or graders. For example, Japanese Patent Publication No. 5247939 discloses digging control. Under the digging control, the position of a blade is automatically adjusted such that the load applied to the blade coincides with a target load.

SUMMARY

With the conventional control described above, the occurrence of a shoe slip can be suppressed by raising the blade when the load on the blade becomes excessively high. This allows the work to be performed efficiently.

However, with the conventional control, as illustrated in FIG. 10, the blade is first controlled to conform to a final design surface 100. If the load on the blade subsequently increases, the blade is raised by load control (see a trajectory 200 of the blade in FIG. 10). Therefore, when digging a topography 300 with large undulations, the load applied to the blade may increase rapidly, causing the blade to rise suddenly. If that happens, a very uneven topography will be formed, making it difficult to perform digging work smoothly. Also, there is a concern that the topography being dug will be prone to becoming rough and the finish quality will suffer.

In addition, with the conventional control, the controller controls the work implement according to a predetermined target value such as a target load of the blade. However, if the target value is not appropriate, a shoe slip will frequently occur. In that case, it is difficult to perform digging work with high efficiency and high quality finish.

An object of the present invention is to provide a control system for a work vehicle, a method, and a work vehicle that enable work with high efficiency and high quality finish under automatic control.

A control system according to a first aspect is a control system for a work vehicle including a travel device and a work implement. The control system includes a controller. The controller is programmed to execute the following processing. The controller controls the work implement according to a predetermined target value. The controller determines whether a slip of the travel device has occurred during control of the work implement. The controller changes the target value according to a result of determination of the slip.

A method according to a second aspect is a method executed by the controller to determine a target design surface indicating a target trajectory of a work implement. The method includes the following processing. A first process is to control the work implement according to a predetermined target value. A second process is to determine whether a slip of the travel device has occurred during control of the work implement. A third process is to change the target value according to a result of determination of the slip.

A work vehicle according to a third aspect is a work vehicle including a travel device, a work implement, and a controller. The controller is programmed to execute the following processing. The controller controls the work implement according to a predetermined target value. The controller determines whether a slip of the travel device has occurred during control of the work implement. The controller changes the target value according to a result of determination of the slip.

According to the present invention, digging can be performed while suppressing an excessive load to a work implement by controlling the work implement according to a target design surface. Accordingly, the quality of the finished work can be improved. Moreover, work efficiency can be improved by automatic control. Further, a target value is changed according to a result of determination of the slip. As a result, occurrence of a slip can be suppressed.

DETAILED DESCRIPTION OF EMBODIMENT(S)

Figure 1:
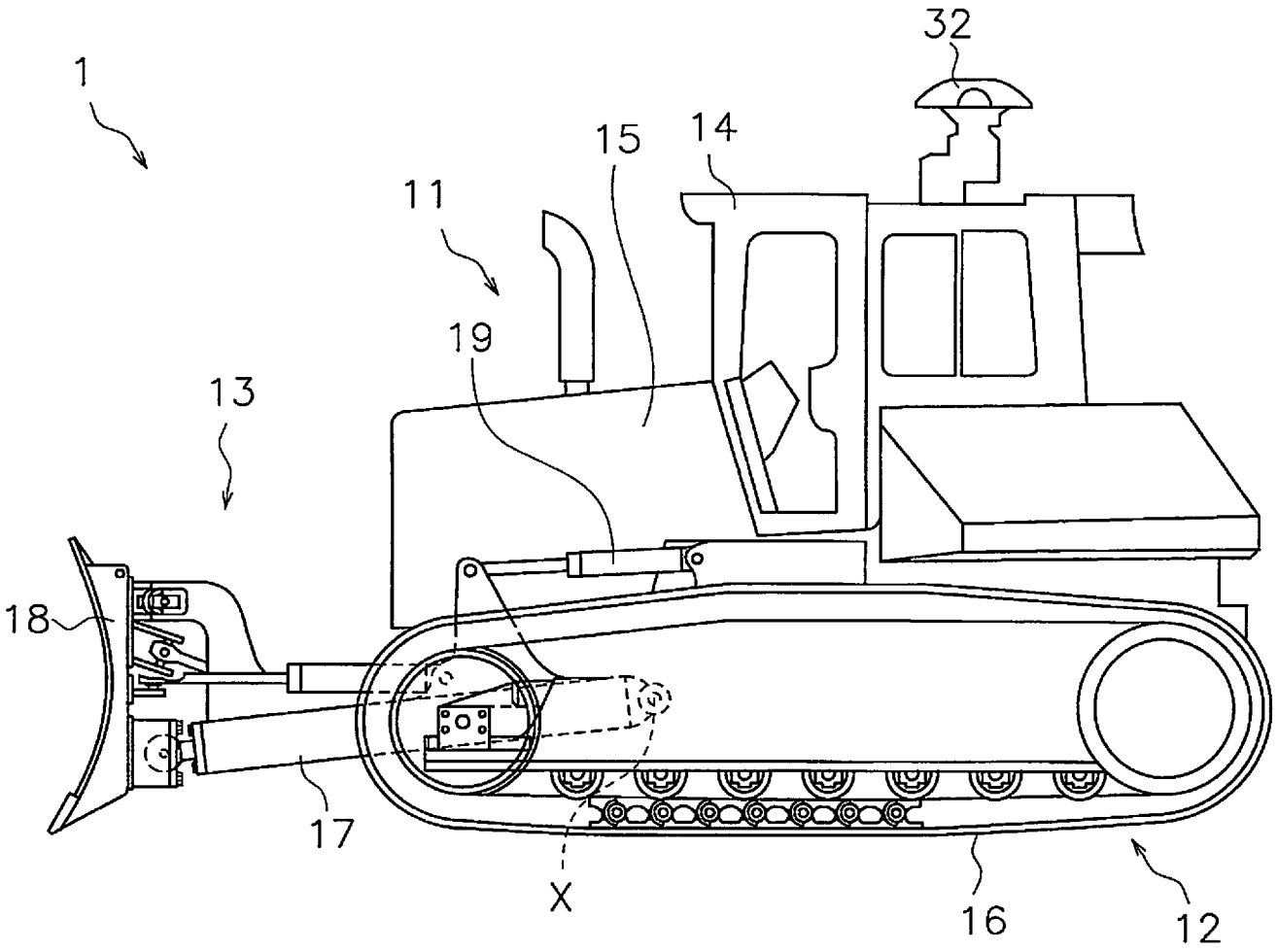
FIG. 1 is a side view of a work vehicle according to an embodiment.

A work vehicle according to an embodiment will now be described with reference to the drawings. FIG. 1 is a side view of a work vehicle 1 according to an embodiment. The work vehicle 1 according to the present embodiment is a bulldozer. The work vehicle 1 includes a vehicle body 11, a travel device 12, and a work implement 13.

The vehicle body 11 includes an operating cabin 14 and an engine compartment 15. An operator's seat that is not illustrated is disposed inside the operating cabin 14. The engine compartment 15 is disposed in front of the operating cabin 14. The travel device 12 is attached to a bottom portion of the vehicle body 11. The travel device 12 includes a pair of right and left crawler belts 16. Only the left crawler belt 16 is illustrated in FIG. 1. The work vehicle 1 travels due to the rotation of the crawler belts 16. The travel of the work vehicle 1 may be either autonomous travel, semi-autonomous travel, or travel by an operation of an operator.

The work implement 13 is attached to the vehicle body 11. The work implement 13 includes a lift frame 17, a blade 18, and a lift cylinder 19. The lift frame 17 is attached to the vehicle body 11 so as to be movable up and down around an axis X extending in the vehicle width direction. The lift frame 17 supports the blade 18.

The blade 18 is disposed in front of the vehicle body 11. The blade 18 moves up and down as the lift frame 17 moves up and down. The lift cylinder 19 is coupled to the vehicle body 11 and the lift frame 17. Due to the extension and contraction of the lift cylinder 19, the lift frame 17 rotates up and down centered on the axis X.

Figure 2:
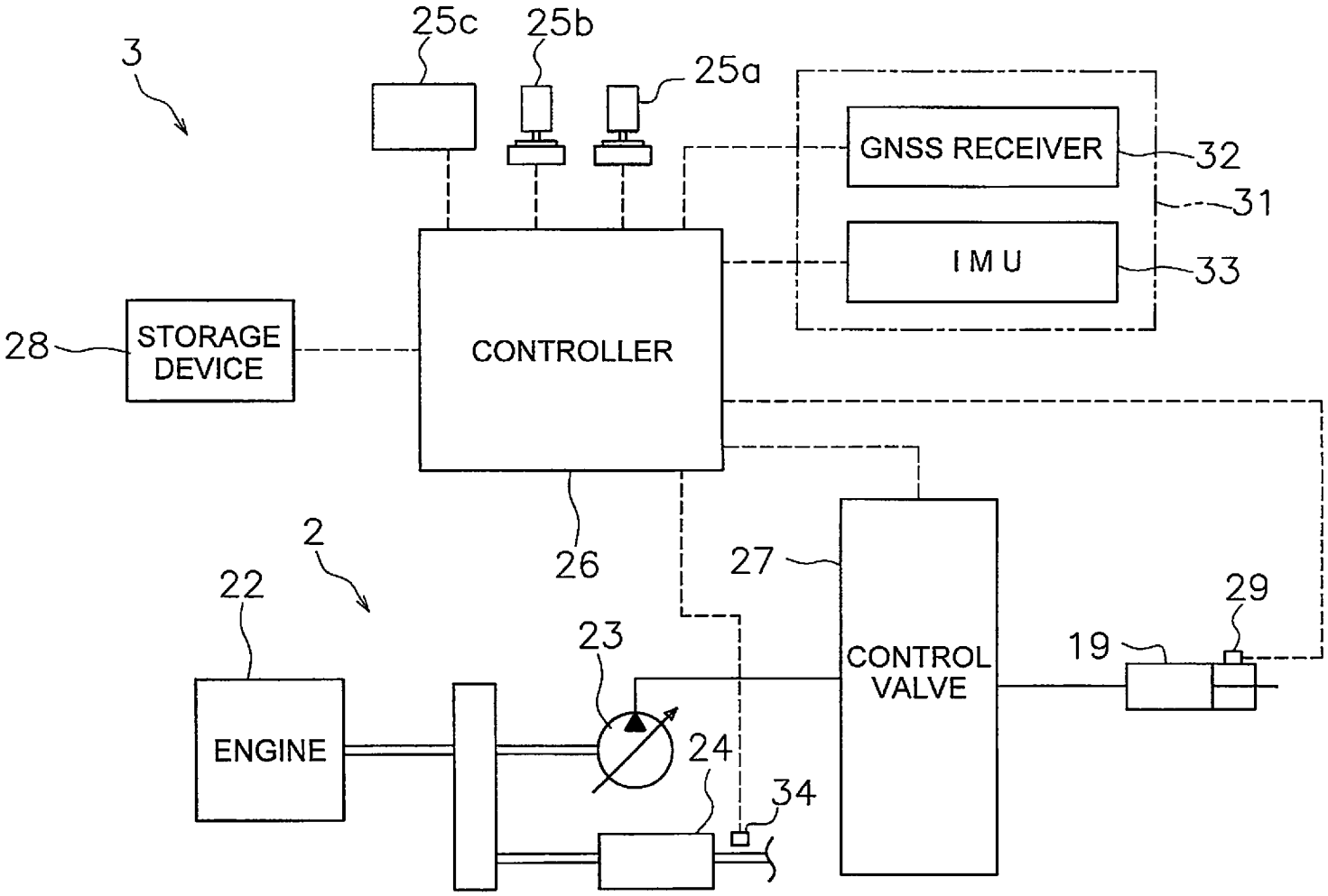
FIG. 2 is a block diagram of a drive system and a control system of the work vehicle.

FIG. 2 is a block diagram illustrating a configuration of a drive system 2 and a control system 3 of the work vehicle 1. As illustrated in FIG. 2, the drive system 2 includes an engine 22, a hydraulic pump 23, and a power transmission device 24.

The hydraulic pump 23 is driven by the engine 22 to discharge hydraulic fluid. The hydraulic fluid discharged from the hydraulic pump 23 is supplied to the lift cylinder 19. While only one hydraulic pump 23 is illustrated in FIG. 2, a plurality of hydraulic pumps may be provided.

The power transmission device 24 transmits driving force from the engine 22 to the travel device 12. The power transmission device 24 may be, for example, a hydrostatic transmission (HST). Alternatively, the power transmission device 24 may be, for example, a torque converter or a transmission having a plurality of transmission gears.

The control system 3 includes an output sensor 34 that senses an output of the power transmission device 24. The output sensor 34 includes, for example, a rotation speed sensor or a pressure sensor. When the power transmission device 24 is an HST including a hydraulic motor, the output sensor 34 may be a pressure sensor that senses hydraulic pressure of the hydraulic motor. The output sensor 34 may be a rotation speed sensor that senses an output rotation speed of the hydraulic motor. When the power transmission device 24 includes a torque converter, the output sensor 34 may be a rotation sensor that senses the output rotation speed of the torque converter. A sensing signal indicating a sensed value of the output sensor 34 is output to the controller 26.

The control system 3 includes a first operating device 25*a*, a second operating device 25*b*, an input device 25*c*, a controller 26, a control valve 27, and a storage device 28. The first operating device 25*a*, the second operating device 25*b*, and the input device 25*c* are disposed in the operating cabin 14. The first operating device 25*a* is a device for operating the travel device 12. The first operating device 25*a* receives an operation by an operator for driving the travel device 12, and outputs an operation signal corresponding to the operation. The second operating device 25*b* is a device for operating the work implement 13. The second operating device 25*b* receives an operation by the operator for driving the work implement 13, and outputs an operation signal corresponding to the operation. The first operating device 25*a* and the second operating device 25*b* include, for example, an operating lever, a pedal, a switch, and the like.

For example, the first operating device 25*a* is configured to be operable at a forward position, a reverse position, and a neutral position. An operation signal indicating the position of the first operating device 25*a* is output to the controller 26. The controller 26 controls the travel device 12 or the power transmission device 24 so that the work vehicle 1 moves forward when the operating position of the first operating device 25*a* is in the forward position. The controller 26 controls the travel device 12 or the power transmission device 24 so that the work vehicle 1 moves in reverse when the operating position of the first operating device 25*a* is in the reverse position, The input device 25*c* is a device for inputting a setting for automatic control of the work implement 13 described later. The input device 25*c* is, for example, a touch screen type display. However, the input device 25*c* may be another device such as a pointing device as a mouse or a trackball, a switch, or a keyboard. The input device 25*c* receives an operation by the operator and outputs an operation signal corresponding to the operation.

The controller 26 is programmed to control the work vehicle 1 based on acquired data. The controller 26 includes, for example, a processor such as a CPU. The controller 26 acquires an operation signal from the first operating device 25*a*, the second operating device 25*b*, and the input device 25*c*. The controller 26 controls the control valve 27 based on the operation signal.

The control valve 27 is a proportional control valve and is controlled by a command signal from the controller 26. The control valve 27 is disposed between a hydraulic actuator such as the lift cylinder 19 and the hydraulic pump 23. The control valve 27 controls the flow rate of the hydraulic fluid supplied from the hydraulic pump 23 to the lift cylinder 19.

The controller 26 generates a command signal to the control valve 27 so that the blade 18 acts in response to the aforementioned operation of the second operating device 25*b*. As a result, the lift cylinder 19 is controlled in response to the operation amount of the second operating device 25*b*. The control valve 27 may be a pressure proportional control valve. Alternatively, the control valve 27 may be an electromagnetic proportional control valve.

Figure 3:
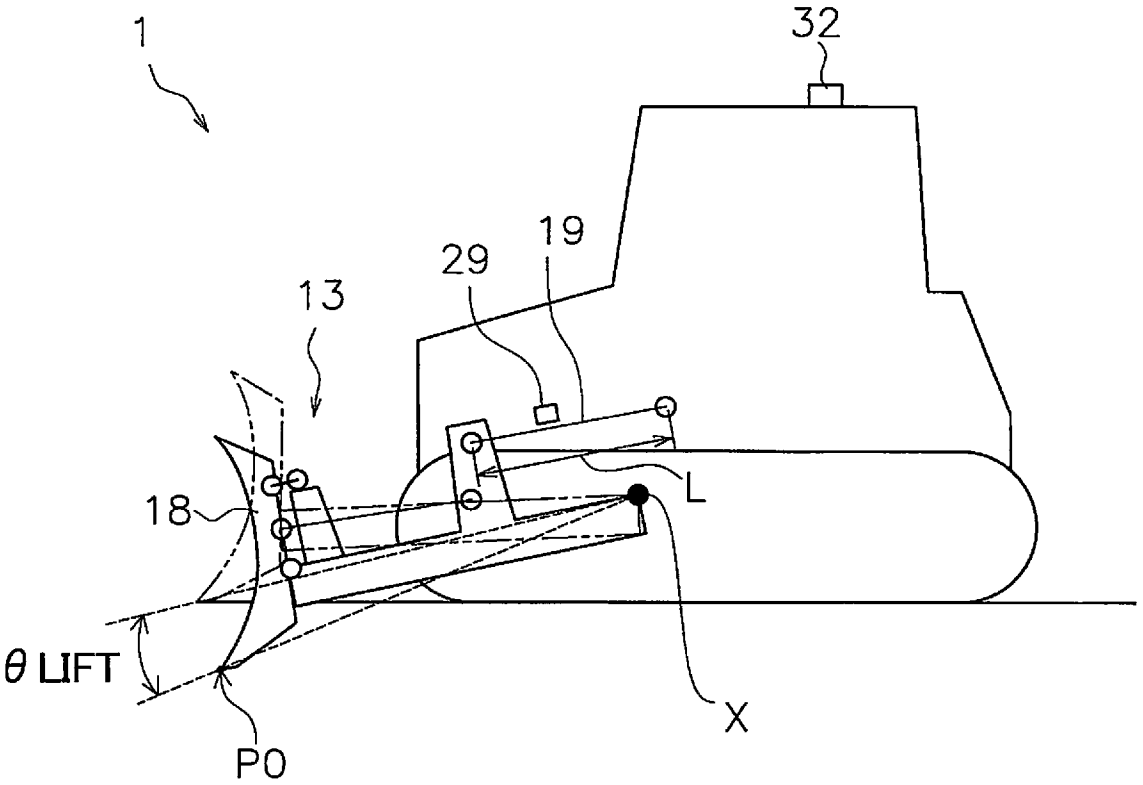
FIG. 3 is a schematic view of a configuration of the work vehicle.

The control system 3 includes a lift cylinder sensor 29. The lift cylinder sensor 29 senses the stroke length (hereinafter referred to as "lift cylinder length L") of the lift cylinder 19. As illustrated in FIG. 3, the controller 26 calculates the lift angle θlift of the blade 18 based on the lift cylinder length L. FIG. 3 is a schematic view of a configuration of the work vehicle 1.

The origin position of the work implement 13 is illustrated as a chain double-dashed line in FIG. 3. The origin position of the work implement 13 is the position of the blade 18 while the tip of the blade 18 is in contact with the ground surface on a horizontal ground surface. The lift angle θlift is the angle from the origin position of the work implement 13.

As illustrated in FIG. 2, the control system 3 includes a position sensor 31. The position sensor 31 measures the position of the work vehicle 1. The position sensor 31 includes a global navigation satellite system (GNSS) receiver 32 and an IMU 33. The GNSS receiver 32 is, for example, a receiver for global positioning system (GPS). An antenna of the GNSS receiver 32 is disposed on the operating cabin 14. The GNSS receiver 32 receives a positioning signal from a satellite and calculates the position of the antenna based on the positioning signal to generate vehicle body position data. The controller 26 acquires the vehicle body position data from the GNSS receiver 32.

The IMU 33 is an inertial measurement unit. The IMU 33 acquires vehicle body inclination angle data. The vehicle body inclination angle data includes an angle (pitch angle) relative to horizontal in the vehicle longitudinal direction and an angle (roll angle) relative to horizontal in the vehicle lateral direction. The controller 26 acquires vehicle body inclination angle data from the IMU 33.

The controller 26 computes a blade tip position P0 from the lift cylinder length L, the vehicle body position data, and the vehicle body inclination angle data. As illustrated in FIG. 3, the controller 26 calculates global coordinates of the GNSS receiver 32 based on the vehicle body position data. The controller 26 calculates the lift angle θlift based on the lift cylinder length L. The controller 26 calculates the local coordinates of the blade tip position P0 with respect to the GNSS receiver 32 based on the lift angle θlift and the vehicle body dimension data.

The controller 26 calculates the traveling direction and the vehicle speed of the work vehicle 1 from the vehicle body position data. The vehicle body dimension data is stored in the storage device 28 and indicates the position of the work implement 13 with respect to the GNSS receiver 32. The controller 26 calculates the global coordinates of the blade tip position P0 based on the global coordinates of the GNSS receiver 32, the local coordinates of the blade tip position P0, and the vehicle body inclination angle data. The controller 26 acquires the global coordinates of the blade tip position P0 as blade tip position data. The blade tip position P0 may be directly calculated by attaching the GNSS receiver to the blade 18.

The storage device 28 includes, for example, a memory and an auxiliary storage device. The storage device 28 may be, for example, a RAM or a ROM. The storage device 28 may be a semiconductor memory or a hard disk. The storage device 28 is an example of a non-transitory computer readable recording medium. The storage device 28 stores computer commands that are executable by the processor and for controlling the work vehicle 1.

The storage device 28 stores work site topography data. The work site topography data indicates an actual topography of the work site. The work site topography data is, for example, a topographical survey map in a three-dimensional data format. The work site topography data can be acquired, for example, by aerial laser survey.

The controller 26 acquires as-built data. The as-built data indicates an as-built surface 50 of the work site. The as-built surface 50 is a topography of a region along the traveling direction of the work vehicle 1. The as-built data is acquired by calculation by the controller 26 from the work site topography data and the position and traveling direction of the work vehicle 1 acquired from the aforementioned position sensor 31.

Figure 4:
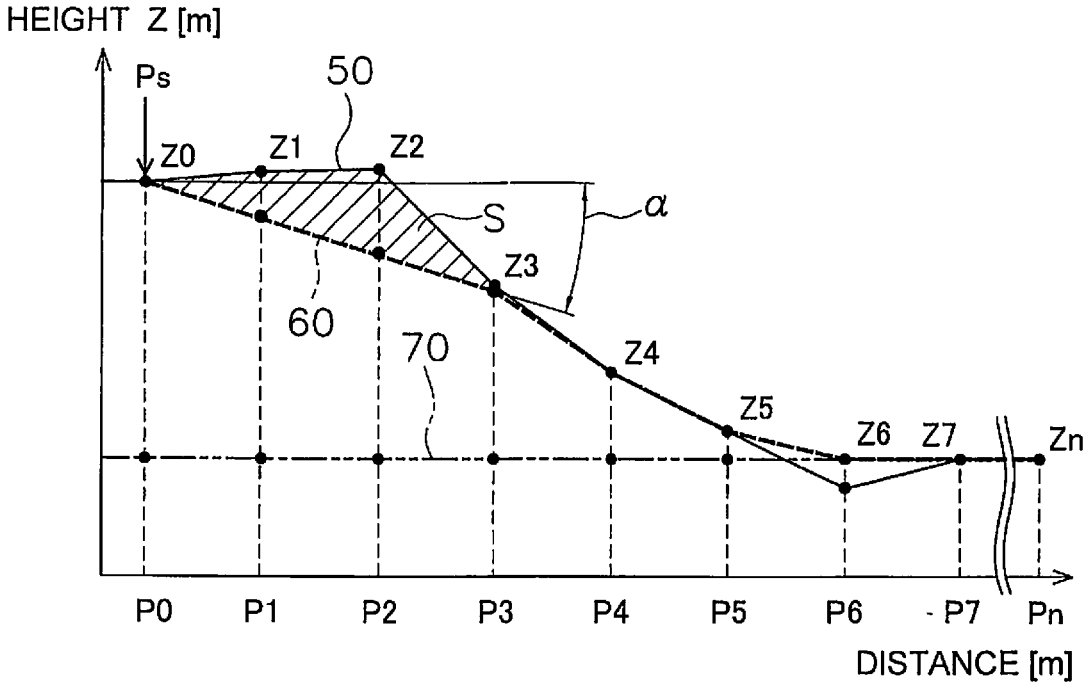
FIG. 4 illustrates an example of a design surface and an as-built surface.

FIG. 4 illustrates an example of a cross section of the as-built surface 50. As illustrated in FIG. 4, the as-built data includes the height of the as-built surface 50 at a plurality of reference points P0 to Pn. Specifically, the as-built data includes the heights Z0 to Zn of the as-built surface 50 at the plurality of reference points P0 to Pn in the traveling direction of the work vehicle 1. The plurality of reference points P0 to Pn are arranged at a predetermined interval. The predetermined interval is, for example, one meter, but may be another value.

In FIG. 4, the vertical axis indicates the height of the topography, and the horizontal axis indicates the distance from the current position in the traveling direction of the work vehicle 1. The current position may be a position determined based on the current blade tip position P0 of the work vehicle 1. The current position may be determined based on the current position of another portion of the work vehicle 1.

The storage device 28 stores design surface data. The design surface data indicates a plurality of design surfaces 60 and 70 that are target trajectories of the work implement 13. As illustrated in FIG. 4, the design surface data includes the heights of the design surfaces 60 and 70 at a plurality of reference points P0 to Pn as in the as-built data. The plurality of design surfaces 60 and 70 include a final design surface 70 and an intermediate target design surface 60 other than the final design surface 70.

The final design surface 70 is the final target shape of the surface of the work site. The final design surface 70 is, for example, a construction drawing in a three-dimensional data format, and is stored in advance in the storage device 28. In FIG. 4, the final design surface 70 includes a flat shape parallel to the horizontal direction, but may have a different shape.

At least a portion of the target design surface 60 is positioned between the final design surface 70 and the as-built surface 50. The controller 26 can generate a desired target design surface 60, generate the design surface data indicating the target design surface 60, and store the design surface data in the storage device 28.

Figure 5:
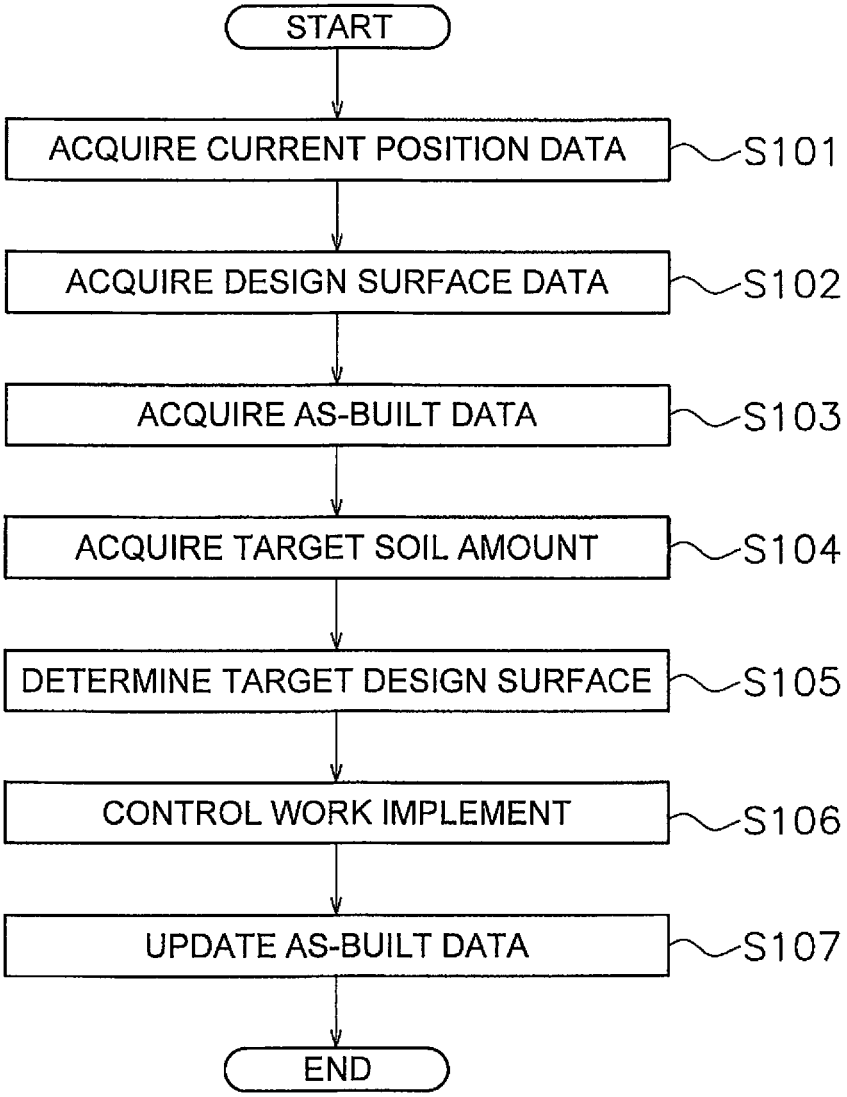
FIG. 5 is a flowchart illustrating automatic control processing of a work implement.

The controller 26 automatically controls the work implement 13 based on the as-built data, the design surface data, and the blade tip position data. The automatic control of the work implement 13 executed by the controller 26 will be described below. FIG. 5 is a flowchart illustrating automatic control processing of the work implement 13.

As illustrated in FIG. 5, in step S101, the controller 26 acquires current position data. The current position data indicates a position of the work vehicle 1 measured by the position sensor 31. As described above, the controller 26 acquires the current blade tip position P0 of the work implement 13 from the current position data. In step S102, the controller 26 acquires design surface data. The controller 26 acquires the design surface data from the storage device 28.

In step S103, the controller 26 acquires as-built data. The controller 26 acquires the as-built data indicating the current as-built surface 50 from the work site topography data and the position and traveling direction of the work vehicle 1. Alternatively, as described later, the controller 26 acquires the as-built data indicating the as-built surface 50 updated upon digging.

In step S104, the controller 26 acquires a target soil amount. The initial value of the target soil amount is stored in the storage device 28. The controller 26 updates the target soil amount according to the occurrence or non-occurrence of a slip (hereinafter referred to as "shoe slip") of the travel device 12. The update of the target soil amount will be described in detail later.

In step S105, the controller 26 determines a target design surface 60. The controller 26 determines the target design surface 60 positioned between the final design surface 70 and the as-built surface 50 from the design surface data indicating the final design surface 70, the as-built data, and the target soil amount. The target design surface 60 is positioned above the final design surface 70 and at least a portion of the target design surface 60 is positioned below the as-built surface 50.

For example, as illustrated in FIG. 4, the controller 26 determines the target design surface 60 linearly extending from a work start position Ps at an inclination angle α. In FIG. 4, the cross-sectional area between the as-built surface 50 and the target design surface 60 indicates an estimated soil amount S held by the work implement 13, when the blade tip of the work implement 13 is moved along the target design surface 60. The controller 26 calculates the inclination angle α so that the estimated soil amount S coincides with the target soil amount.

The controller 26 increases the inclination angle α as the target soil amount increases. Therefore, the controller 26 increases the distance from the as-built surface 50 of the work target to the target design surface 60 as the target soil amount increases. The controller 26 determines the target design surface 60 so that the target design surface 60 will not be positioned below the final design surface 70.

In the present embodiment, the size of the as-built surface 50 in the width direction of the work vehicle 1 is not considered. However, the soil amount may be calculated by considering the size of the as-built surface 50 in the width direction of the work vehicle 1.

The work start position Ps is, for example, the blade tip position P0 when the blade tip of the work implement 13 is moved to a position equal to or less than a predetermined height. The movement of the blade tip of the work implement 13 may be performed by the operator operating the second operating device 25*b*. Alternatively, the movement of the blade tip of the work implement 13 may be performed by the controller controlling the work implement 13.

The controller 26 may determine the target design surface 60 by another method. For example, the controller 26 may determine a surface acquired by vertically displacing the as-built surface 50 by a predetermined distance as the target design surface 60. In that case, the controller 26 may calculate the amount of displacement of the as-built surface 50 so that the estimated soil amount S coincides with the target soil amount.

In step S106, the controller 26 controls the work implement 13. The controller 26 automatically controls the work implement 13 according to the target design surface 60. Specifically, the controller 26 generates a command signal to the work implement 13 so that the blade tip position P0 of the blade 18 moves toward the target design surface 60. The generated command signal is input to the control valve 27. As a result, the blade tip position P0 of the work implement 13 moves along the target design surface 60.

For example, when the target design surface 60 is positioned above the as-built surface 50, soil will be piled on the as-built surface 50 by the work implement 13. When the target design surface 60 is positioned below the as-built surface 50, the as-built surface 50 is dug by the work implement 13.

In step S107, the controller 26 updates the as-built surface 50. For example, the controller 26 records the blade tip position of the work implement 13 during work, and stores the blade tip position in the storage device 28. The controller 26 updates the data indicating a trajectory of the blade tip position of the work implement 13 as as-built data indicating a new as-built surface 50.

The above processing is performed while the work vehicle 1 is moving forward. The controller 26 may start controlling the work implement 13 when a signal to operate the work implement 13 is output from the second operating device 25*b*. The movement of the work vehicle 1 may be performed by the operator manually operating the first operating device 25*a*. Alternatively, the movement of the work vehicle 1 may be performed automatically in a response to a command signal from the controller 26.

For example, when the first operating device 25*a* is in the forward position, the above processing is performed to automatically control the work implement 13. When the work vehicle 1 moves in reverse, the controller 26 stops the control of the work implement 13. For example, when the first operating device 25*a* is in the reverse position, the controller 26 stops the control of the work implement 13. Subsequently, when the work vehicle 1 starts moving forward again, the controller 26 performs the aforementioned processes from step S101 to step S107 again.

Accordingly, the process from when the work vehicle 1 starts moving forward to when the work vehicle switches to moving in reverse is defined as one work path. The work vehicle 1 moves in reverse to return to the work start position Ps, and the work vehicle 1 starts moving forward again, whereby a subsequent work path is executed. The work start position Ps may be the same as the work start position in the previous work path. Alternatively, the work start position Ps may be a new work start position different from the work start position in the previous work path. By repeating such work paths, the as-built surface 50 can be dug to approach the final design surface 70.

Next, update of a target soil amount will be described. The controller 26 determines whether a shoe slip has occurred and changes a target soil amount according to the result of the shoe slip determination. In the following description, the target soil amount is indicated as a percentage (%) to the maximum capacity of the blade 18. The target soil amount may be indicated by another parameter such as volume.

Figure 6:
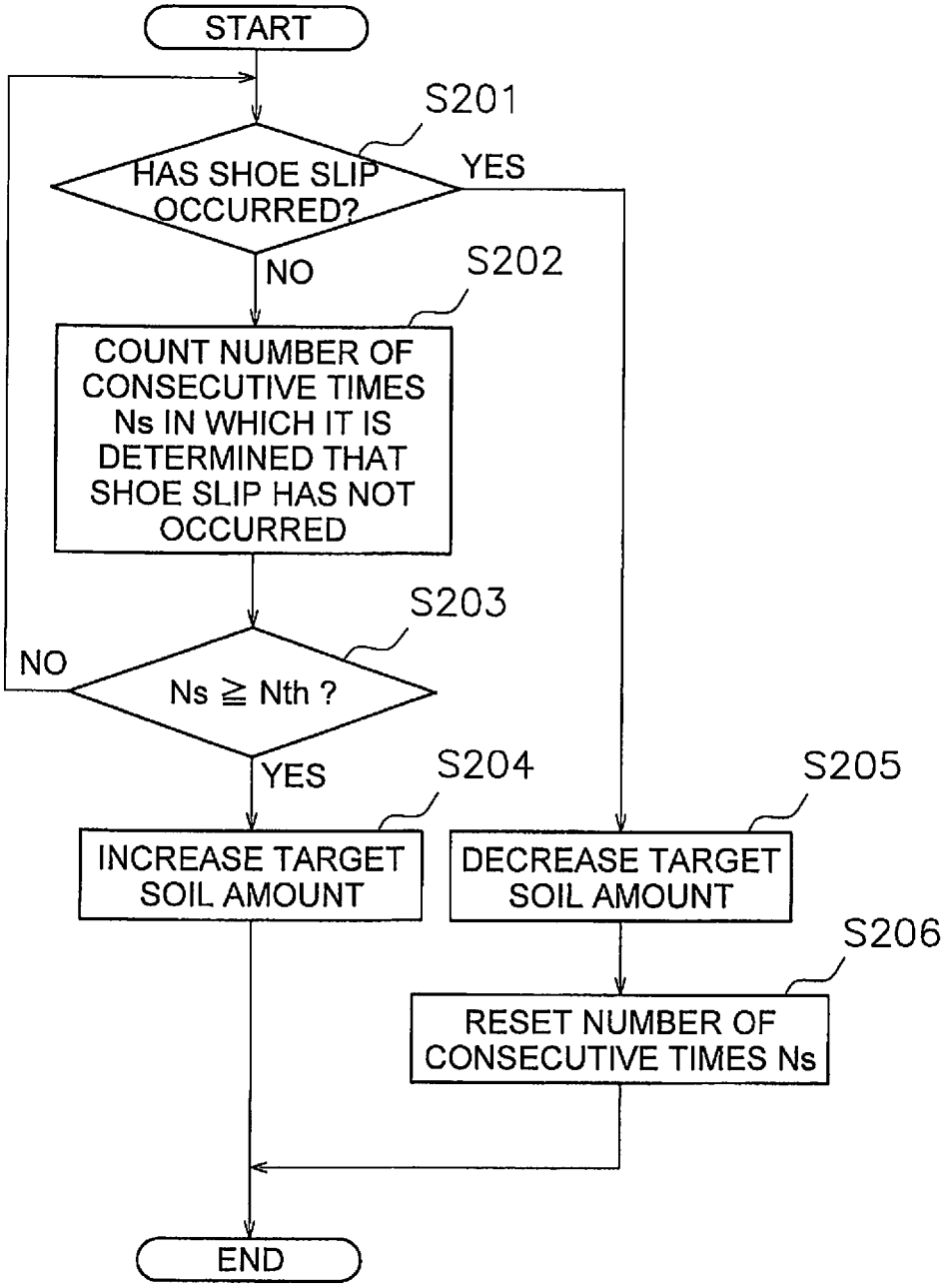
FIG. 6 is a flowchart illustrating update processing of a target soil amount.

FIG. 6 is a flowchart illustrating a processing for updating a target soil amount. The processing illustrated in FIG. 6 is performed by each work path.

First, when the work vehicle 1 starts moving forward in step S201, the controller 26 determines whether a shoe slip has occurred in step S202. For example, the controller 26 calculates the shoe slip rate Rs by the following formula (1).

$$Rs=1-Vw/Vc \quad (1)$$

Vw is the vehicle speed of the work vehicle 1. The controller 26 calculates the vehicle speed Vw from the vehicle body position data sensed by the position sensor 31. Vc is the moving speed of the crawler belts 16. The controller 26 calculates the moving speed Vc of the crawler belts 16 from the output of the power transmission device 24 sensed by the output sensor 34.

The controller 26 determines whether a shoe slip has occurred by the following formula (2).

$$Rs>Rth \quad (2)$$

Rth is a predetermined slip determination threshold. The controller 26 determines that a shoe slip has occurred when the shoe slip rate Rs is higher than the slip determination threshold Rth. The controller 26 determines that a shoe slip has not occurred when the shoe slip rate Rs is equal to or less than the slip determination threshold Rth.

When it is determined that a shoe slip has not occurred in step S202, the process proceeds to step S203. In step S203, the controller 26 counts the number of consecutive times Ns in which it is determined that a shoe slip has not occurred.

When the work vehicle 1 starts moving in reverse in step S204, the controller 26 determines whether the number of consecutive times Ns is equal to or greater than a predetermined threshold of number of times Nth in step S205. When the number of consecutive times Ns is equal to or greater than the predetermined threshold of number of times Nth, the process proceeds to step S206.

In step S206, the controller 26 increases the target soil amount. For example, the controller 26 adds a predetermined additional value to the target soil amount. The additional value is 5%, for example. However, the additional value may be smaller than 5%. Alternatively, the additional value may be greater than 5%.

When the number of consecutive times Ns is smaller than the predetermined threshold of number of times Nth in step S205, the process returns to step S201, and the controller 26 determines again whether a shoe slip has occurred in the subsequent work path.

When the controller 26 determines that a shoe slip has occurred in step S202, the process proceeds to step S207. In step S207, the controller 26 reduces the target soil amount. For example, the controller 26 subtracts a predetermined subtracted value from the target soil amount. The subtracted value is 5%, for example. However, the subtracted value may be smaller than 5%. Alternatively, the subtracted value may be greater than 5%. The subtracted value may be different from the additional value.

In step S208, the controller 26 resets the number of consecutive times Ns. For example, when the controller 26 determines that a slip has not occurred in two consecutive work paths, the number of consecutive times Ns is two. In the subsequent work path, when the controller 26 determines that a slip has occurred, the controller 26 resets the number of consecutive times Ns to zero.

Figure 7:
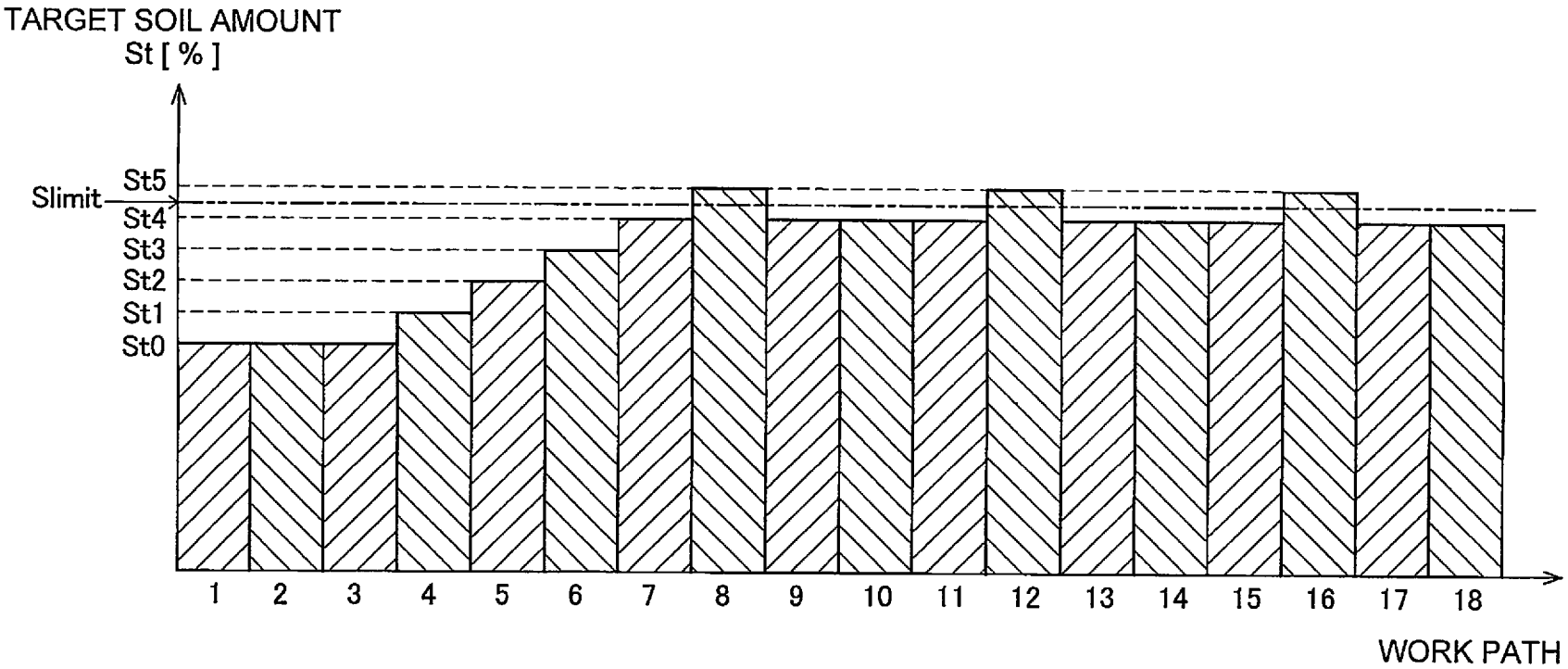
FIG. 7 illustrates an example of updating a target soil amount.

FIG. 7 illustrates an example of update of the target soil amount. In FIG. 7, Slimit indicates the amount of soil which is the occurrence limit of the shoe slip. Therefore, a shoe slip does not occur when the target soil amount is equal to or less than the shoe slip occurrence limit Slimit, and a shoe ship occurs when the target soil amount is greater than the slip occurrence limit Slimit.

In FIG. 7, St0 is an initial value of the target soil amount. The initial value St0 may be a fixed value determined based on the capacity of the blade 18, for example. Alternatively, the target soil amount St may be optionally set by the operator operating the input device 25*c*. In the example illustrated in FIG. 7, the threshold of number of times Nth is three. However, the threshold of number of times Nth is not limited to three and may be another value.

As illustrated in FIG. 7, the controller 26 determines that a shoe slip has not occurred in the first and second work paths. In the first and second work paths, because the number of consecutive times Ns is smaller than the threshold of number of times Nth, the controller 26 maintains the target soil amount at the initial value St0.

Next, the controller 26 determines that a shoe slip has not occurred in the third work path. In this case, because the number of consecutive times Ns is equal to or greater than the threshold of number of times Nth, the controller 26 increases the target soil amount from the initial value St0 to St1 in the subsequent fourth work path.

When the controller 26 determines that a shoe slip has not occurred in the fourth work path, the controller 26 further increases the target soil amount from St1 to St2 in the subsequent fifth work path. That is, while the number of consecutive times Ns is equal to or greater than the threshold of number of times Nth, the controller 26 increases the target soil amount every time when the controller determines that a shoe slip has not occurred. Therefore, as illustrated in FIG. 7, the controller 26 increases the target soil amount sequentially from the fourth work path to the eighth work path.

In the eighth work path, the target soil amount is St5 which is greater than the slip occurrence limit Slimit. Therefore, a slip occurs in the eighth work path. When the controller 26 determines that a slip has occurred in the eighth work path, the controller 26 reduces the target soil amount from St5 to St4 in the subsequent ninth work path. Also, the controller 26 resets the number of consecutive times Ns to zero.

In the subsequent 10th and 11th work paths, the controller 26 determines that a slip has not occurred, but maintains the target soil amount at St4 because the number of consecutive times Ns is smaller than the threshold of number of times Nth. When the controller 26 determines that a slip has not occurred in the 11th work path, the number of consecutive times Ns becomes equal to or greater than the threshold of number of times Nth. Therefore, the controller 26 increases the target soil amount from St4 to St5 in the subsequent 12th work path. Subsequently, in the 12th to 18th work paths, the target soil amount is increased or decreased repeatedly.

The controller 26 stores the updated target soil amount in the storage device 28 as needed. When one work path ends and the subsequent work path starts, the controller 26 determines the target design surface 60 using the updated target soil amount as an initial value. The controller 26 determines whether a slip has occurred in a subsequent work path, and updates the target soil amount based on the result of the determination.

According to the control system 3 of the work vehicle 1 according to the embodiment described above, when the target design surface 60 is positioned below the as-built surface 50, digging can be performed while suppressing an excessive load to the work implement 13 by controlling the work implement 13 along the target design surface 60. Accordingly, the quality of the finished work can be improved. Moreover, work efficiency can be improved by automatic control.

Further, the target soil amount is changed according to the result of the slip determination, and the target design surface 60 is determined according to the changed target soil amount. Therefore, the occurrence of slip can be suppressed.

In addition, in order to suppress an occurrence of slip, the target soil amount is preferably equal to or less than the slip occurrence limit Slimit. On the other hand, in order to further improve the work efficiency, the target soil amount is preferably as large as possible. Therefore, the target soil amount is preferably a value near the slip occurrence limit Slimit and below the slip occurrence limit Slimit. However, a slip occurrence limit Slimit varies depending on the soil quality of the work site. Also, even if the soil quality is the same, the slip occurrence limit Slimit varies depending on the topography of the work site or the environment. Therefore, it is difficult to accurately grasp the slip occurrence limit Slimit in advance.

However, in the control system 3 of the work vehicle 1 according to the present embodiment, the target soil amount is updated based on the number of times that a slip has actually occurred. Therefore, the target soil amount can be set to a value near the slip occurrence limit Slimit by updating the target soil amount while performing work. As a result, work efficiency can be improved.

Although an embodiment of the present invention has been described so far, the present invention is not limited to the above embodiment and various modifications may be made within the scope of the invention.

The work vehicle 1 is not limited to the bulldozer but may be another vehicle such as a wheel loader or a motor grader. The work vehicle 1 may be remotely operable. In this case, a portion of the control system 3 may be disposed outside of the work vehicle 1. For example, the controller 26 may be disposed outside of the work vehicle 1. The controller 26 may be disposed inside a control center separated from the work site.

The travel device 12 is not limited to the crawler belts 16 and may have other driving parts. For example, the travel device 12 may have wheels and tires.

The controller 26 may display a guidance screen indicating the target design surface 60, instead of controlling the work implement 13 according to the target design surface 60. In this case, the controller 26 updates the target design surface 60 based on the target soil amount changed by the result of the slip determination. Then, the controller 26 can provide the operator with the appropriate target design surface 60 by displaying the updated target design surface 60 on the guidance screen.

The controller 26 may change the target value other than the target soil amount according to the result of the slip determination. The target value is preferably a target value of a parameter indicating the load to the work implement. For example, the controller 26 may change a target traction force according to the result of the slip determination. The controller 26 may determine the target design surface 60 so that the traction force of the work vehicle is the target traction force.

In that case, the controller 26 may calculate the traction force from the sensed value of the output sensor 34. For example, when the power transmission device 24 of the work vehicle 1 is HST, the controller 26 can calculate the traction force from the hydraulic pressure of the hydraulic motor and the rotational speed of the hydraulic motor. Alternatively, when the power transmission device 24 includes a torque converter and a transmission, the controller 26 can calculate the traction force from the input torque to the transmission and the transmission reduction ratio. The input torque to the transmission can be calculated from the output rotation speed of the torque converter. However, the method of sensing the traction force is not limited to the aforementioned ones, and may be sensed by another method.

Figure 8:
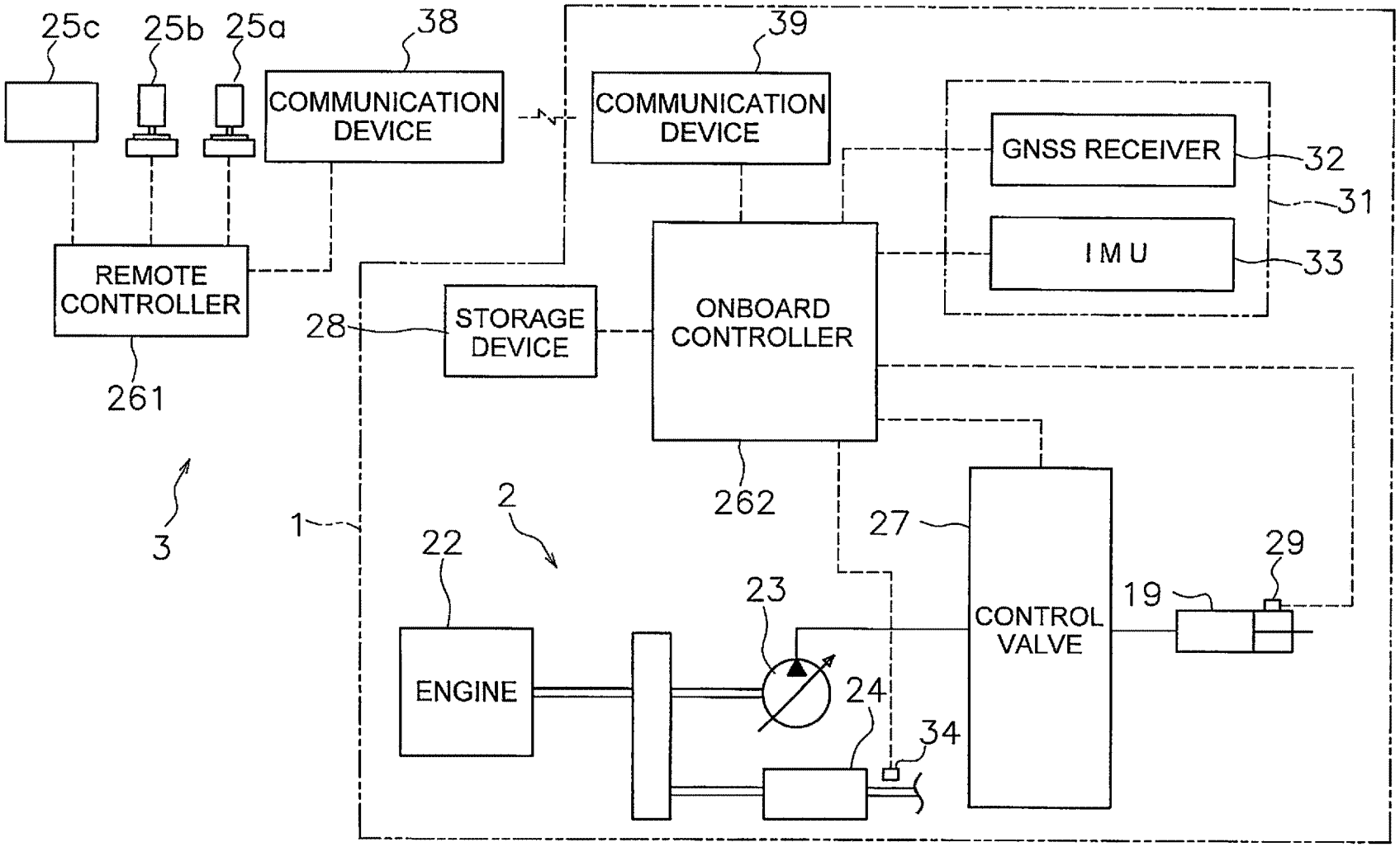
FIG. 8 is a block diagram of a configuration of a drive system and a control system of a work vehicle according to another embodiment.

The controller 26 may have a plurality of controllers 26 separated from each other. For example, as illustrated in FIG. 8, the controller 26 may include a remote controller 261 disposed outside of the work vehicle 1 and an onboard controller 262 mounted on the work vehicle 1. The remote controller 261 and the onboard controller 262 may be able to communicate wirelessly via communication devices 38 and 39. One or some of the aforementioned functions of the controller 26 may be executed by the remote controller 261, and the remaining functions may be executed by the onboard controller 262. For example, the processing for determining the target design surface 60 may be performed by the remote controller 261, and the processing for outputting a command signal to the work implement 13 may be performed by the onboard controller 262.

The operating devices 25*a* and 25*b* and the input device 25*c* may be disposed outside the work vehicle 1. In this case, the operating cabin may be omitted from the work vehicle 1. Alternatively, the operating devices 25*a* and 25*b* and the input device 25*c* may be omitted from the work vehicle 1. The work vehicle 1 may be operated only by the automatic control by the controller 26 without operations of the operating devices 25*a* and 25*b* and the input device 25*c*.

Figure 9:
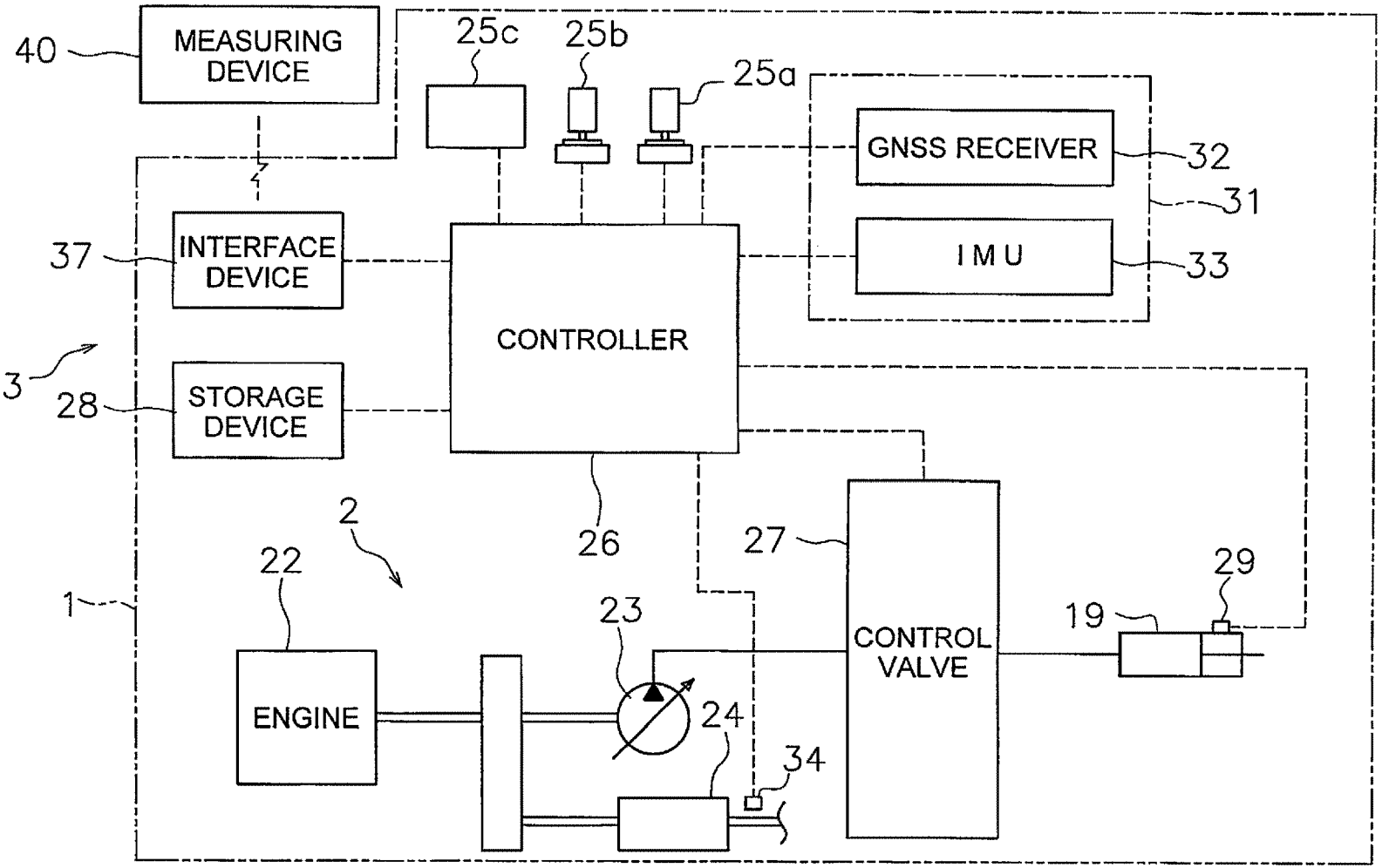
FIG. 9 is a block diagram of a configuration of a drive system and a control system of a work vehicle according to another embodiment.
Figure 10:
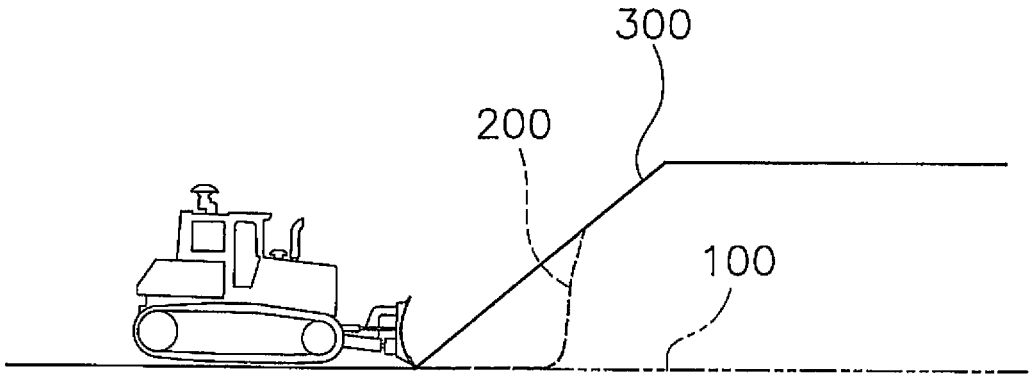
FIG. 10 illustrates an example of the related art.

The as-built surface 50 may be acquired by another device, instead of the aforementioned position sensor 31. For example, as illustrated in FIG. 9, the as-built surface 50 may be acquired by the interface device 37 that receives data from an external device. The interface device 37 may wirelessly receive the as-built data measured by the external measuring device 40.

For example, aviation laser survey may be used as an external measuring device. Alternatively, the as-built surface 50 may be imaged by a camera, and the as-built data may be generated from image data captured by the camera. For example, aerial photographic survey using an unmanned aerial vehicle (UAV) may be used. Alternatively, the interface device 37 may be a recording medium reading device and may receive the as-built data measured by the external measuring device 40 via the recording medium.

The present invention provides a control system for a work vehicle, a method, and a work vehicle that enable work with high efficiency and high quality finish.

The invention claimed is:

1. A control system for a work vehicle including a travel device and a work implement, the control system comprising:

a controller configured to determine a target design surface in accordance with a target value such that a distance from an as-built surface of a work target to the target design surface increases as the target value increases, the target design surface indicating a target trajectory of the work implement, control the work implement according to the target trajectory, determine whether a slip of the travel device has occurred during control of the work implement, and change the target value according to a result of determination of the slip, the controller being configured to increase the target value upon determining that the slip has not occurred.

2. The control system for a work vehicle according to claim 1, wherein the determining that the slip has not occurred includes determining that the slip has not occurred for a predetermined number of consecutive times.

3. The control system for a work vehicle according to claim 1, wherein the controller is further configured to decrease the target value upon determining that the slip has occurred.

4. The control system for a work vehicle according to claim 1, wherein the target value is a target traction force, and the controller is further configured to control the work implement so that a traction force of the work vehicle coincides with the target traction force.

5. The control system for a work vehicle according to claim 1, wherein the controller is further configured to determine whether the slip has occurred during execution of a first work path, and determine the target value for a second work path according to a result of determination of the slip.

6. The control system for a work vehicle according to claim 1, wherein the target value is a parameter indicating a load to the work implement.

7. A control system for a work vehicle including a travel device and a work implement, the control system comprising:

a controller configured to control the work implement according to a target value, the target value being a target soil amount, control the work implement so that a soil amount dug by the work implement coincides with the target soil amount, determine whether a slip of the travel device has occurred during control of the work implement, and change the target value according to a result of determination of the slip, the controller being configured to increase the target value upon determining that the slip has not occurred.

8. The control system for a work vehicle according to claim 7, wherein the determining that the slip has not occurred includes determining that the slip has not occurred for a predetermined number of consecutive times.

9. The control system for a work vehicle according to claim 7, wherein the controller is further configured to decrease the target value upon determining that the slip has occurred.

10. The control system for a work vehicle according to claim 7, wherein the controller is further configured to determine whether the slip has occurred during execution of a first work path, and determine the target value for a second work path according to a result of determination of the slip.

11. A method for controlling a work implement performed by a controller, the method comprising:

determining a target design surface in accordance with a target value such that a distance from an as-built surface of a work target to the target design surface increases as the target value increases, the target design surface indicating a target trajectory of the work implement, controlling the work implement according to the target trajectory;

determining whether a slip of a travel device has occurred during control of the work implement; and changing the target value according to a result of determination of the slip, the changing the target value including increasing the target value upon determining that the slip has not occurred.

12. The method according to claim 11, wherein the determining that the slip has not occurred includes determining that the slip has not occurred for a predetermined number of consecutive times.

13. The method according to claim 11, wherein the changing the target value includes decreasing the target value upon determining that the slip has occurred.

14. The method according to claim 11, wherein the target value is a target soil amount, and the controlling the work implement includes controlling the work implement so that a soil amount to be dug by the work implement coincides with the target soil amount.

15. The method according to claim 11, wherein the target value is a target traction force, and the controlling the work implement includes controlling the work implement so that a traction force of the work vehicle coincides with the target traction force.

16. The method according to claim 11, further comprising:

determining whether the slip has occurred during execution of a first work path; and determining the target value for a second work path according to a result of determination of the slip.

17. The method according to claim 11, wherein the target value is a parameter indicating a load to the work implement.

* * * * *